US009502769B2

(12) United States Patent
Tsai et al.

(10) Patent No.: US 9,502,769 B2
(45) Date of Patent: Nov. 22, 2016

(54) MULTIBAND SWITCHABLE ANTENNA STRUCTURE

(71) Applicant: Quanta Computer Inc., Taoyuan (TW)

(72) Inventors: Chin-Lung Tsai, Taoyuan (TW); Chung-Ting Hung, Taoyuan (TW); Ying-Cong Deng, Taoyuan (TW); Chung-Hung Lo, Taoyuan (TW); Kuan-Hsien Lee, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 11 days.

(21) Appl. No.: 14/695,817

(22) Filed: Apr. 24, 2015

(65) Prior Publication Data

US 2016/0156101 A1 Jun. 2, 2016

(30) Foreign Application Priority Data

Nov. 28, 2014 (TW) ..... 103141339 A

(51) Int. Cl.
*H01Q 9/00* (2006.01)
*H01Q 5/328* (2015.01)
*H01Q 9/42* (2006.01)

(52) U.S. Cl.
CPC ..... *H01Q 5/328* (2015.01); *H01Q 9/42* (2013.01)

(58) Field of Classification Search
CPC ..... H01Q 5/328
See application file for complete search history.

(56) References Cited

U.S. PATENT DOCUMENTS

2009/0278755 A1* 11/2009 Shoji ..... H01Q 1/24 343/745
2011/0102290 A1* 5/2011 Milosavljevic ..... H01Q 1/243 343/852
2011/0128200 A1 6/2011 Hossain et al.
2013/0154897 A1* 6/2013 Sorensen ..... H01Q 7/005 343/861
2013/0194139 A1* 8/2013 Nickel ..... H01Q 5/328 343/703
2014/0253398 A1* 9/2014 Hsieh ..... H01Q 5/328 343/745

FOREIGN PATENT DOCUMENTS

TW I 436620 5/2014

OTHER PUBLICATIONS

Chinese language office action dated Dec. 18, 2015, issued in application No. TW 103141339.

* cited by examiner

*Primary Examiner* — Trinh Dinh
(74) *Attorney, Agent, or Firm* — McClure, Qualey & Rodack, LLP

(57) ABSTRACT

A multiband switchable antenna structure includes a feeding element, a first radiation element, a second radiation element, circuit branches, and a switch circuit. A first end of the feeding element is a feeding point. A first end of the first radiation element is coupled to a second end of the feeding element. A second end of the first radiation element is open. A first end of the second radiation element is coupled to the second end of the feeding element. The circuit branches have different impedance values. The switch circuit selects one of the circuit branches as a matching branch according to a control signal. A second end of the second radiation element is coupled through the matching branch to a ground voltage.

9 Claims, 7 Drawing Sheets

MULTIBAND SWITCHABLE ANTENNA STRUCTURE

CROSS REFERENCE TO RELATED APPLICATIONS

This Application claims priority of Taiwan Patent Application No. 103141339 filed on Nov. 28, 2014, the entirety of which is incorporated by reference herein.

BACKGROUND OF THE INVENTION

Field of the Invention

The disclosure generally relates to an antenna structure, and more specifically, to a multiband switchable antenna structure for use in a mobile device.

Description of the Related Art

With the progress of mobile communication technology, mobile devices, for example, portable computers, mobile phones, tablet computers, multimedia players, and other hybrid functional portable electronic devices, have become more common. To satisfy the needs of users, mobile devices usually can perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi and Bluetooth systems and using frequency bands of 2.4 GHz, 5.2 GHz, and 5.8 GHz.

A conventional design often uses a metal element with a fixed size as an antenna body of a mobile device. The metal element has a length of 0.5 or 0.25 wavelength corresponding to the desired frequency band. As a result, a conventional antenna design merely covers a single frequency band or a narrow frequency band, and it cannot meet the requirements of a current mobile device operating in multiple or wide frequency bands.

BRIEF SUMMARY OF THE INVENTION

In a preferred embodiment, the disclosure is directed to a multiband switchable antenna structure including a feeding element, a first radiation element, a second radiation element, circuit branches, and a switch circuit. A first end of the feeding element is a feeding point. A first end of the first radiation element is coupled to a second end of the feeding element. A second end of the first radiation element is open. A first end of the second radiation element is coupled to the second end of the feeding element. The circuit branches have different impedance values. The switch circuit selects one of the circuit branches as a matching branch according to a control signal. A second end of the second radiation element is coupled through the matching branch to a ground voltage.

In some embodiments, the second end of the first radiation element extends away from the feeding point, and the second end of the second radiation element extends toward the feeding point.

In some embodiments, the feeding element substantially has an L-shape.

In some embodiments, the first radiation element substantially has an L-shape.

In some embodiments, the second radiation element substantially has an L-shape.

In some embodiments, the circuit branches include an open-circuited branch, an inductive branch, a capacitive branch, and a short-circuited branch.

In some embodiments, the feeding element, the first radiation element, the second radiation element, and the matching branch are excited to generate a low-frequency band, and the low-frequency band is substantially from 700 MHz to 960 MHz.

In some embodiments, the multiband switchable antenna structure further includes a third radiation element. A first end of the third radiation element is the feeding point, and a second end of the third radiation element is open and adjacent to the feeding point.

In some embodiments, the multiband switchable antenna structure further includes a fourth radiation element. A first end of the fourth radiation element is coupled to a central portion of the feeding element, and a second end of the fourth radiation element is open.

In some embodiments, the third radiation element is excited to generate a first high-frequency band, the fourth radiation element is excited to generate a second high-frequency band, the first high-frequency band is substantially from 2300 MHz to 2700 MHz, and the second high-frequency band is substantially from 1710 MHz to 2170 MHz.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Figure 1:
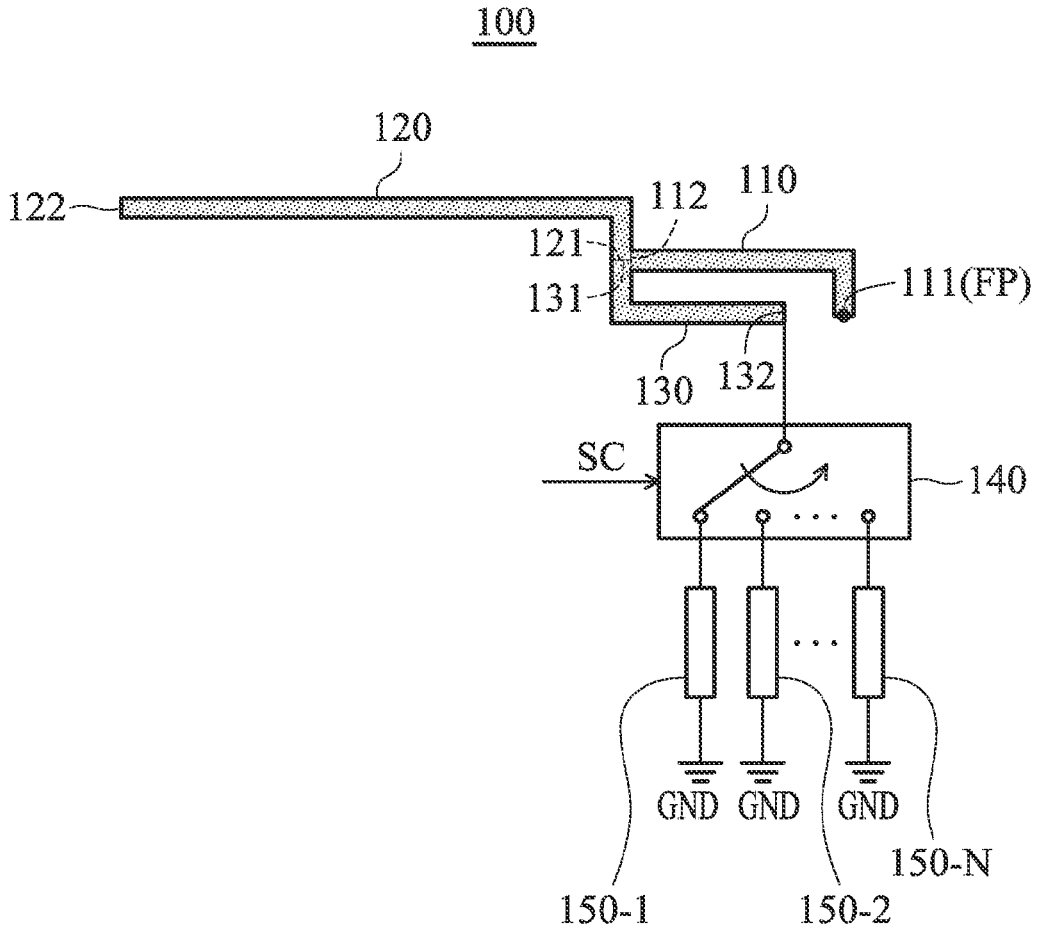
FIG. 1 is a diagram of a multiband switchable antenna structure according to an embodiment of the invention.

FIG. 1 is a diagram of a multiband switchable antenna structure 100 according to an embodiment of the invention. The multiband switchable antenna structure 100 may be applied to a mobile device, such as a smartphone, a tablet computer, or a notebook computer. In some embodiments, the multiband switchable antenna structure 100 is disposed on a nonconductive carrier element (e.g., a dielectric substrate), and at an edge of the interior of the mobile device.

As shown in FIG. 1, the multiband switchable antenna structure 100 at least includes a feeding element 110, a first radiation element 120, a second radiation element 130, a switch circuit 140, and circuit branches 150-1, 150-2, . . . , and 150-N (N may be a positive integer which is greater than or equal to 2). The feeding element 110, the first radiation element 120, and the second radiation element 130 may be all made of conductive materials, such as metal. The switch circuit 140 may be implemented with one or more transistors. The circuit branches 150-1, 150-2, . . . , and 150-N may include a variety of circuit elements which have different impedance values.

The feeding element 110 may substantially have an L-shape. The feeding element 110 has a first end 111 and a second end 112. The first end 111 of the feeding element 110 is a feeding point FP. The feeding point FP may be coupled to a signal source (not shown), such as an RF (Radio Frequency) module for exciting the multiband switchable antenna structure 100. The first radiation element 120 may substantially have an L-shape. The first radiation element 120 has a first end 121 and a second end 122. The first end 121 of the first radiation element 120 is coupled to a second end 112 of the feeding element 110. The second end 122 of the first radiation element 120 is open. The second radiation element 130 has a first end 131 and a second end 132. The first end 131 of the second radiation element 130 is coupled to the second end 112 of the feeding element 110. The second end 132 of the second radiation element 130 is coupled to the switch circuit 140. In particular, the second end 122 of the first radiation element 120 may extend away from the feeding point FP, and the second end 132 of the second radiation element 130 may extend toward the feeding point FP. The length of the first radiation element 120 may generally longer than that of the second radiation element 130. A combination of the first radiation element 120 and the second radiation element 130 may substantially have an N-shape or a Z-shape.

The switch circuit 140 selects one of the circuit branches 150-1, 150-2, . . . , and 150-N as a matching branch according to a control signal SC. The second end 132 of the second radiation element 130 is coupled through the selected matching branch to a ground voltage VSS. The feeding element 110, the first radiation element 120, the second radiation element 130, and the selected matching branch are excited to generate a low-frequency band. The low-frequency band may be substantially from 700 MHz to 960 MHz. In some embodiments, the control signal SC is generated by a processor (not shown). In alternative embodiments, the control signal SC is generated according to a user input signal. In other embodiments, the control signal SC is generated according to a detection signal. The detection signal is a detection result of a sensor for detecting the frequency of nearby electromagnetic waves (not shown). By controlling the switch circuit 140, the second radiation element 130 of the multiband switchable antenna structure 100 can be coupled through different impedance elements to the ground voltage VSS, so as to generate a variety of effective resonant lengths. As a result, the multiband switchable antenna structure 100 can achieve multiband and wideband operations without changing the total antenna size. The multiband switchable antenna structure 100 of the invention is suitable for application in a variety of current small mobile communication devices.

Figure 2:
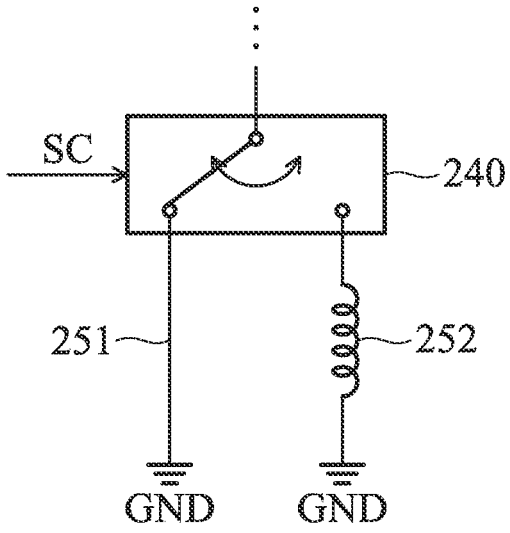
FIG. 2 is a diagram of a switch circuit and circuit branches according to an embodiment of the invention.

FIG. 2 is a diagram of a switch circuit 240 and circuit branches 251 and 252 according to an embodiment of the invention. The switch circuit 240 and the circuit branches 251 and 252 of FIG. 2 may be applied to the multiband switchable antenna structure 100 of FIG. 1. In the embodiment of FIG. 2, the circuit branches 251 and 252 include a short-circuited branch and an inductive branch. When the switch circuit 240 switches to the inductive branch, the low operating frequency of the multiband switchable antenna structure 100 is relatively low. When the switch circuit 240 switches to the short-circuited branch, the low operating frequency of the multiband switchable antenna structure 100 is relatively medial.

Figure 3:
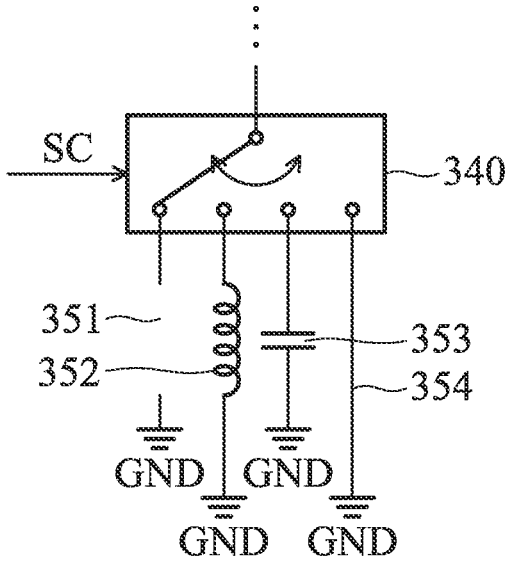
FIG. 3 is a diagram of a switch circuit and circuit branches according to an embodiment of the invention.

FIG. 3 is a diagram of a switch circuit 340 and circuit branches 351, 352, 353, and 354 according to an embodiment of the invention. The switch circuit 340 and the circuit branches 351, 352, 353, and 354 of FIG. 3 may be applied to the multiband switchable antenna structure 100 of FIG. 1. In the embodiment of FIG. 3, the circuit branches 351, 352, 353, and 354 include an open-circuited branch, an inductive branch, a capacitive branch, and a short-circuited branch. When the switch circuit 340 switches to the inductive branch, the low operating frequency of the multiband switchable antenna structure 100 is relatively low. When the switch circuit 340 switches to the short-circuited branch, the low operating frequency of the multiband switchable antenna structure 100 is relatively medial. When the switch circuit 340 switches to the capacitive branch, the low operating frequency of the multiband switchable antenna structure 100 is relatively high. On the other hand, the open-circuited branch is configured to adjust the high operating frequency of the multiband switchable antenna structure 100.

Figure 4:
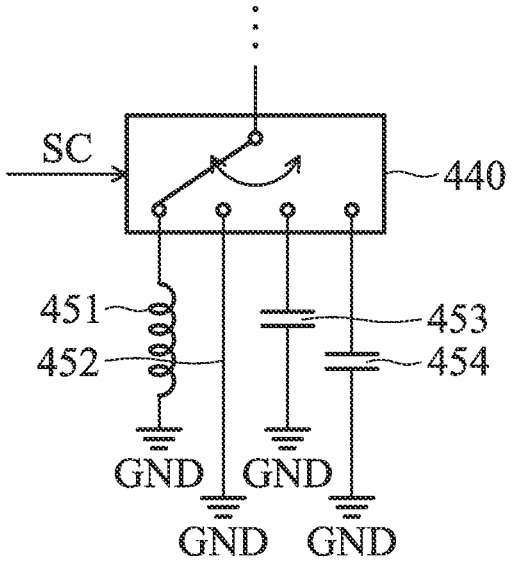
FIG. 4 is a diagram of a switch circuit and circuit branches according to an embodiment of the invention.

FIG. 4 is a diagram of a switch circuit 440 and circuit branches 451, 452, 453, and 454 according to an embodiment of the invention. The switch circuit 440 and the circuit branches 451, 452, 453, and 454 of FIG. 4 may be applied to the multiband switchable antenna structure 100 of FIG. 1. In the embodiment of FIG. 4, the circuit branches 451, 452, 453, and 454 include an inductive branch, a short-circuited branch, a first capacitive branch, and a second capacitive branch. The first capacitive branch and the second capacitive branch may have different capacitances. When the switch circuit 440 switches to the inductive branch, the low operating frequency of the multiband switchable antenna structure 100 is relatively low. When the switch circuit 440 switches to the short-circuited branch, the low operating frequency of the multiband switchable antenna structure 100 is relatively medial. When the switch circuit 440 switches to the first capacitive branch or the second capacitive branch, the low operating frequency of the multiband switchable antenna structure 100 is relatively high.

Figure 5:
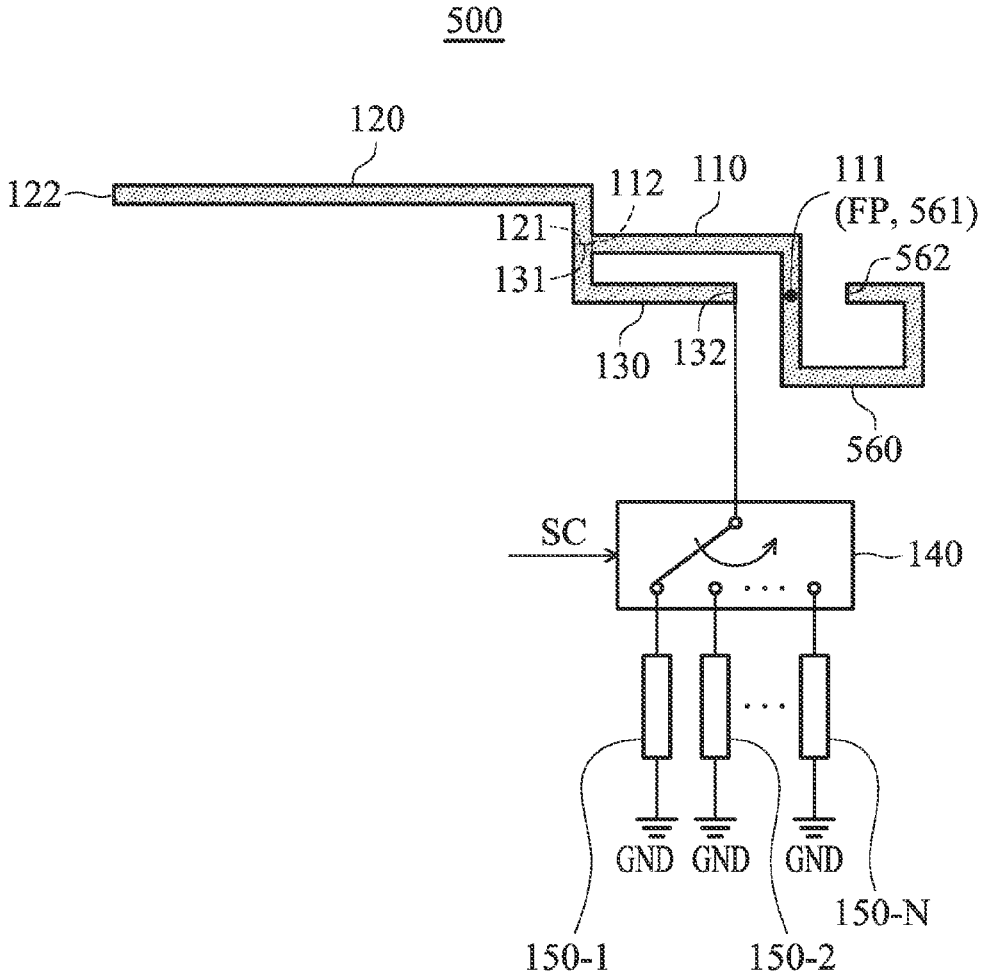
FIG. 5 is a diagram of a multiband switchable antenna structure according to an embodiment of the invention.

FIG. 5 is a diagram of a multiband switchable antenna structure 500 according to an embodiment of the invention. FIG. 5 is similar to FIG. 1. The difference between the two embodiments is that the multiband switchable antenna structure 500 further includes a third radiation element 560. The third radiation element 560 may substantially have a C-shape. The third radiation element 560 has a first end 561 and a second end 562. The first end 561 of the third radiation element 560 is a feeding point FP of the multiband switchable antenna structure 500. The second end 562 of the third radiation element 560 is open and adjacent to the feeding point FP. The third radiation element 560 can be excited to generate a first high-frequency band. The first high-frequency band is substantially from 2300 MHz to 2700 MHz. Other features of the multiband switchable antenna structure 500 of FIG. 5 are similar to those of the multiband switchable antenna structure 100 of FIG. 1. Therefore, the two embodiments can achieve similar levels of performance.

Figure 6:
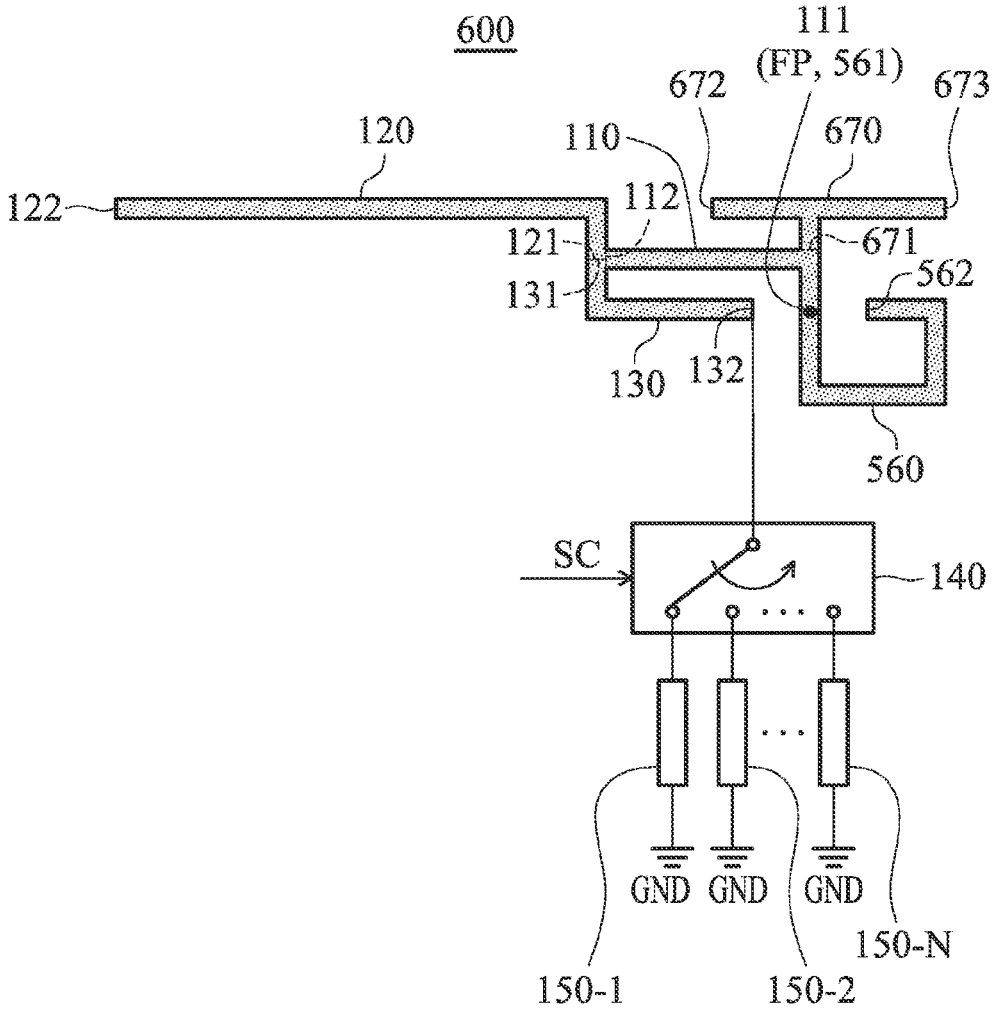
FIG. 6 is a diagram of a multiband switchable antenna structure according to an embodiment of the invention.

FIG. 6 is a diagram of a multiband switchable antenna structure 600 according to an embodiment of the invention. FIG. 6 is similar to FIG. 5. The difference between the two embodiments is that the multiband switchable antenna structure 600 further includes a fourth radiation element 670. The fourth radiation element 670 may substantially have a T-shape or an L-shape (not shown). The fourth radiation element 670 has a first end 671, a second end 672, and a third end 673. The first end 671 of the fourth radiation element 670 is coupled to a central portion of the feeding element 110 (e.g., the right-angle turning point of the L-shaped feeding element 110). The second end 672 and the third end 673 of the fourth radiation element 670 are open, and extend away from each other. The fourth radiation element 670 can be excited to generate a second high-frequency band, and the second high-frequency band is substantially from 1710 MHz to 2170 MHz. The fourth radiation element 670 is configured to adjust the impedance matching of the multiband switchable antenna structure 600. Other features of the multiband switchable antenna structure 600 of FIG. 6 are similar to those of the multiband switchable antenna structure 500 of FIG. 5. Therefore, the two embodiments can achieve similar levels of performance.

Figure 7:
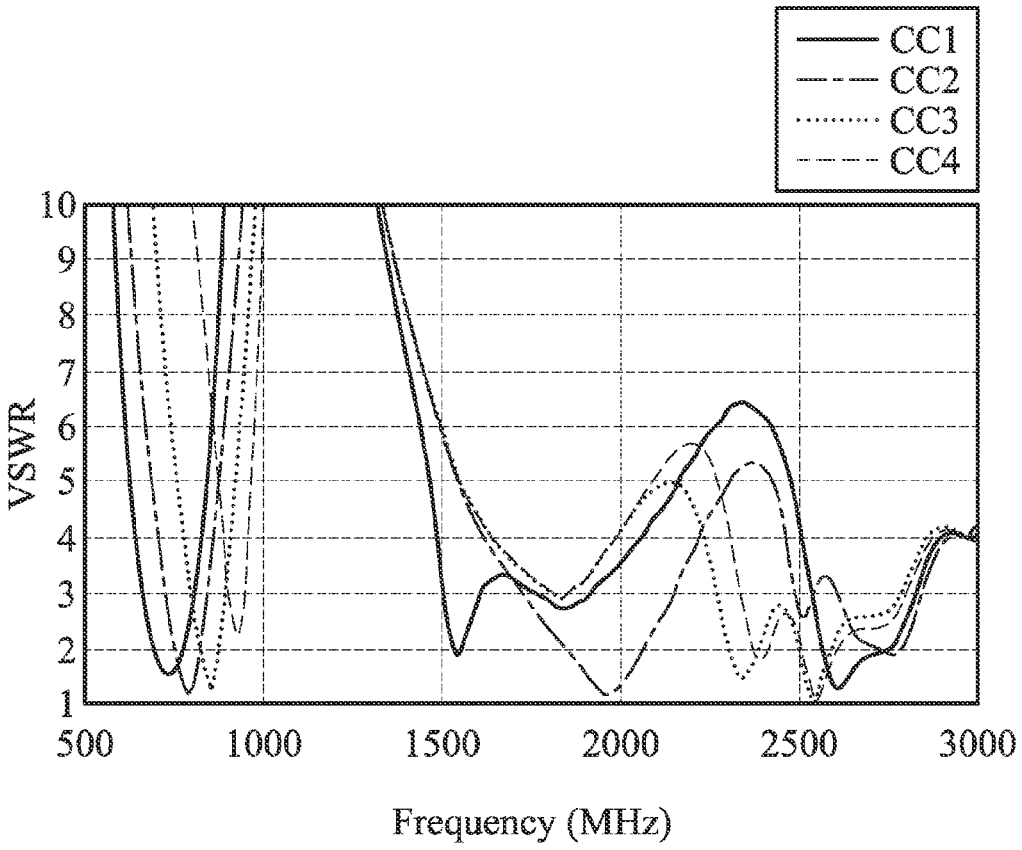
FIG. 7 is a diagram of a VSWR (Voltage Standing Wave Ratio) of a multiband switchable antenna structure according to an embodiment of the invention.

FIG. 7 is a diagram of a VSWR (Voltage Standing Wave Ratio) of the multiband switchable antenna structure 600 according to an embodiment of the invention. The horizontal axis represents operating frequency (MHz), and the vertical axis represents the VSWR. FIG. 7 shows the measurement result of the multiband switchable antenna structure 600 of FIG. 6. The multiband switchable antenna structure 600 may include the inductive branch, the short-circuited branch, the first capacitive branch, and the second capacitive branch of FIG. 4. As shown in FIG. 7, a first curve CC1 represents the selection of the inductive branch (e.g., the inductance is about 6.8 nH) as the matching branch, a second curve CC2 represents the selection of the short-circuited branch as the matching branch, a third curve CC3 represents the selection of the first capacitive branch (e.g., the capacitance is about 15 pF) as the matching branch, and a fourth curve CC4 represents the selection of the second capacitive branch (e.g., the capacitance is about 4.7 pF) as the matching branch. According to the measurement result of FIG. 7, when the inductive branch is selected, the low operating frequency of the multiband switchable antenna structure 600 is relatively low; when the short-circuited branch is selected, the low operating frequency of the multiband switchable antenna structure 600 is relatively medial; and when the first capacitive branch or the second capacitive branch is selected, the low operating frequency of the multiband switchable antenna structure 600 is relatively high. The high operating frequency of the multiband switchable antenna structure 600 also varies with the selection of different matching branches. Therefore, by switching between circuit branches with different impedance values, the multiband switchable antenna structure 600 can easily support multiband and wideband operations, and meet the requirements of functions of current mobile communication devices.

Figure 8:
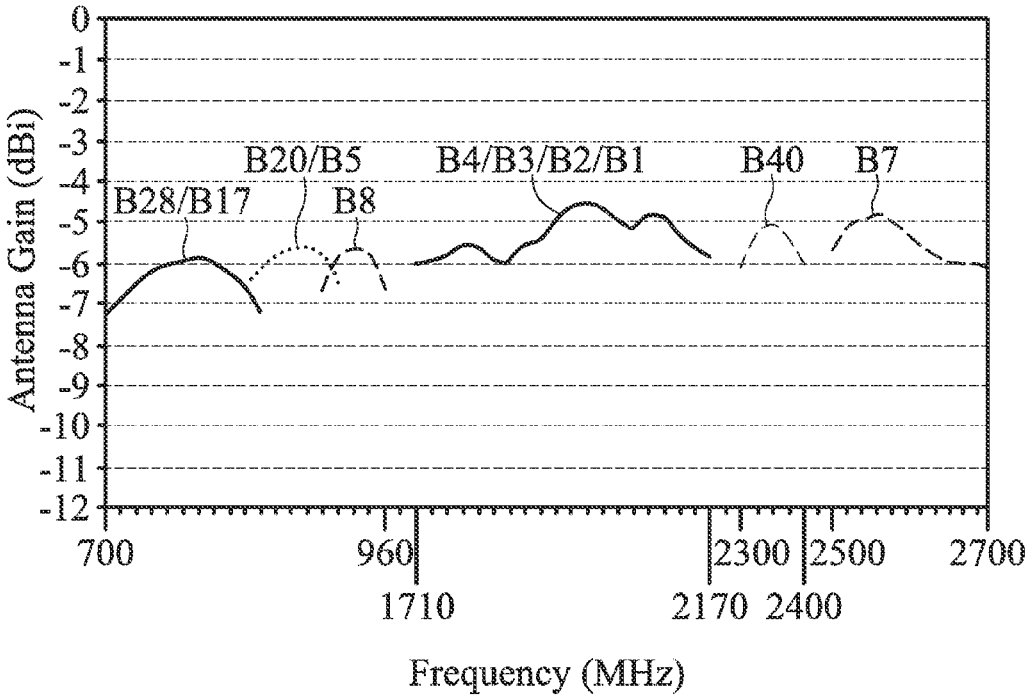
FIG. 8 is a diagram of antenna gain of a multiband switchable antenna structure according to an embodiment of the invention.

FIG. 8 is a diagram of antenna gain of the multiband switchable antenna structure 600 according to an embodiment of the invention. The horizontal axis represents operating frequency (MHz), and the vertical axis represents the antenna gain (dBi). According to the measurement result of FIG. 8, the multiband switchable antenna structure 600 of the invention has good antenna gain over the frequency bands of LTE B28/B17/B20/B5/B8/B4/B3/B2/B1/B40/B7, and it can meet the criterion of general mobile communication devices.

The invention proposes a novel multiband switchable antenna structure. The proposed multiband switchable antenna structure can be designed in limited space of a mobile device, and it has at least the advantages of simple structure, low cost, wide frequency band, and high efficiency. The invention can solve the problem in the prior art.

Note that the above element sizes, element shapes, and frequency ranges are not limitations of the invention. An antenna engineer can adjust these settings or values according to different requirements. It is understood that the multiband switchable antenna structure of the invention are not limited to the configurations of FIGS. 1-8. The invention may merely include any one or more features of any one or more embodiments of FIGS. 1-8. In other words, not all of the features shown in the figures should be implemented in the multiband switchable antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A multiband switchable antenna structure, comprising:

a feeding element, wherein a first end of the feeding element is a feeding point;

a first radiation element, wherein a first end of the first radiation element is coupled to a second end of the feeding element, and a second end of the first radiation element is open;

a second radiation element, wherein a first end of the second radiation element is coupled to the second end of the feeding element;

a plurality of circuit branches, having different impedance values;

a switch circuit, selecting one of the circuit branches as a matching branch according to a control signal, wherein a second end of the second radiation element is coupled through the matching branch to a ground voltage; and a third radiation element, wherein a first end of the third radiation element is the feeding point, and a second end of the third radiation element is open and adjacent to the feeding point;

wherein the third radiation element substantially has a C-shape, and the feeding point is positioned between the second end of the third radiation element and the second end of the second radiation element.

2. The multiband switchable antenna structure as claimed in claim 1, wherein the second end of the first radiation element extends away from the feeding point, and the second end of the second radiation element extends toward the feeding point.

3. The multiband switchable antenna structure as claimed in claim 1, wherein the feeding element substantially has an L-shape.

4. The multiband switchable antenna structure as claimed in claim 1, wherein the first radiation element substantially has an L-shape.

5. The multiband switchable antenna structure as claimed in claim 1, wherein the second radiation element substantially has an L-shape.

6. The multiband switchable antenna structure as claimed in claim 1, wherein the circuit branches comprise an open-circuited branch, an inductive branch, a capacitive branch, and a short-circuited branch.

7. The multiband switchable antenna structure as claimed in claim 1, wherein the feeding element, the first radiation element, the second radiation element, and the matching branch are excited to generate a low-frequency band, and the low-frequency band is substantially from 700 MHz to 960 MHz.

8. The multiband switchable antenna structure as claimed in claim 1, further comprising:

a fourth radiation element, wherein a first end of the fourth radiation element is coupled to a central portion of the feeding element, and a second end of the fourth radiation element is open.

9. The multiband switchable antenna structure as claimed in claim 8, wherein the third radiation element is excited to generate a first high-frequency band, the fourth radiation element is excited to generate a second high-frequency band, the first high-frequency band is substantially from 2300 MHz to 2700 MHz, and the second high-frequency band is substantially from 1710 MHz to 2170 MHz.

* * * * *